US006710742B1

(12) United States Patent
Meredith

(10) Patent No.: US 6,710,742 B1
(45) Date of Patent: Mar. 23, 2004

(54) ACTIVE ANTENNA ROOF TOP SYSTEM AND METHOD

(75) Inventor: Sheldon K. Meredith, Duvall, WA (US)

(73) Assignee: Kathrein-Werke KG, Rosenheim (DE)

( * ) Notice: Subject to any disclaimer, the term of this patent is extended or adjusted under 35 U.S.C. 154(b) by 16 days.

(21) Appl. No.: 10/002,518

(22) Filed: Oct. 23, 2001

(51) Int. Cl.[7] ..... H01Q 3/24

(52) U.S. Cl. ..... 342/373; 342/372; 342/374

(58) Field of Search ..... 342/368, 372, 342/373, 374

(56) References Cited

U.S. PATENT DOCUMENTS

| | | | | |
|---|---|---|---|---|
| 5,548,295 A | * | 8/1996 | Lo Forti et al. | 342/373 |
| 5,917,371 A | | 6/1999 | Chesarek et al. | |
| 5,955,920 A | | 9/1999 | Reudink et al. | |
| 6,320,540 B1 | | 11/2001 | Meredith | |
| 2002/0113655 A1 | * | 8/2002 | Lautzenhiser et al. | 330/295 |

OTHER PUBLICATIONS

U.S. patent application Ser. No. 09/519,987, Feuerstein et al., filed Mar. 7, 2000.

* cited by examiner

*Primary Examiner*—Dao Phan
(74) *Attorney, Agent, or Firm*—Fulbright & Jaworski L.L.P.

(57) ABSTRACT

Disclosed are systems and methods for providing amplitude or power adjustment of a plurality of corresponding signals by shifting power among various outputs associated with the corresponding signals. Accordingly, power steering circuitry of the present invention is provided in a signal path to accept input signals and distribute the power of the input signal among output signals. A preferred embodiment of the power steering circuitry of the present invention provides a multiple stage configuration wherein a first stage operates to shift power and select a power bias among subsets of the outputs while a subsequent stage or stages provide further granularity with respect to shifting of power among the outputs. According to a preferred embodiment, power shifters include an arrangement of back-to-back hybrid combiners having phase adjusting circuitry disposed there between. Accordingly, a preferred embodiment of the power steering circuitry of the present invention provides a matrix of back-to-back hybrid combiners to provide desired steering of signal power.

62 Claims, 6 Drawing Sheets

ACTIVE ANTENNA ROOF TOP SYSTEM AND METHOD

CROSS-REFERENCE TO RELATED APPLICATIONS

The present application is related to copending and commonly assigned U.S. patent application Ser. No. 09/456,194, entitled "Establishing Remote Beam Forming Reference Line," filed Dec. 7, 1999, the disclosure of which is hereby incorporated herein by reference.

BACKGROUND OF THE INVENTION

It is common in the art to utilize an antenna array comprised of a plurality of antenna elements in order to illuminate a selected area with a signal or signals. Often such an array is used in combination with beam forming techniques, such as phase shifting the signal associated with particular antenna elements of the array, such that the signals from the excited elements combine to form a desired beam, or radiation pattern, having a predetermined shape and/or direction.

For example beam forming matrices coupled to an antenna array, such as a phased array panel antenna, have been used in providing multiple antenna beams. One such solution utilizes a four by four Butler matrix, having four inputs to accept radio frequency signals and four outputs each of which is coupled to an antenna element or column of elements of a panel phase array antenna, to provide four antenna beams, such as four 30° directional antenna beams. Each of the antenna beams of the above phased array is associated with a particular input of the beam forming matrix such that a signal appearing at a first input of the beam forming matrix will radiate in a first antenna beam. This is accomplished by the input signal being provided to each of the four antenna elements, coupled to the outputs of the beam forming matrix, as signal components having a proper phase and/or power relation to one another. Likewise, a signal appearing at a second input of the beam forming matrix will radiate in a second antenna beam. As above, this is accomplished by the input signal being provided to each of the four antenna elements as signal components having a proper phase and/or power relation to one another which is different than the phase and/or power relation as between the signal components of the first beam. Accordingly, the beam forming matrix provides a spatial transform of the signal provided at a single input of the beam forming matrix.

A system such as the multiple beam system described above may be utilized to communicate signals in areas other than those of each individual antenna beam. For example, in the above described embodiment providing four 30° directional antenna beams, a signal might be simulcast from a plurality of the antenna beams to thereby communicate the signal in an area different than that associated with a single antenna beam, e.g., two antenna beams to synthesize a 60° beam or four of the antenna beams to synthesize a 120° beam. However, it should be appreciated that each of the antenna beams in the above described simulcast has a common phase center, i.e., each antenna beam sourced from the aforementioned beam forming matrix using the same antenna elements results in each such antenna beam having a common point of origin or phase center. Therefore, in order to avoid undesired destructive combining of the signal simulcast, it is desirable to present the signal to be simulcast to the beam forming inputs with a zero relative phase distribution, i.e., in the four input Butler matrix example discussed above a relative phase distribution of a signal to be simulcast on each of the four antenna beams would preferably be 0°, 0°, 0°, 0°, or each simulcast signal in phase at their respective beam forming matrix inputs.

Moreover, where a zero relative phase distribution is present at the beam forming inputs, beam shaping or additional beam forming control may be predictably accomplished through the use of signal amplitude or power level control. For example, to provide a desired radiation pattern a signal may be simulcast on several antenna beams with a different amplitude (whether a signal of greater or lesser magnitude) as provided to one or more of the beam forming inputs. Such systems may be utilized to provide synthesized antenna beam patterns substantially more complex than the aforementioned composite antenna beam patterns otherwise associated with a simulcast technique.

However, disposing signal attenuators in the antenna beam signal paths subsequent to amplification of the signal for transmission will generally result in dissipation of a portion of the power component of the signal. Achieving the power levels often required for proper signal communication, such as the power levels required of a cellular or PCS base transceiver station (BTS), is typically a very expensive proposition. Accordingly, it is not generally desired to utilize a system structure in which a portion of this power is dissipated or otherwise not actually utilized in the transmission of the signal.

One solution to the problem of not fully utilizing signal power for transmission of the signal might be to place the signal attenuation circuitry in the antenna beam signal paths prior to amplification of the signal for transmission. Accordingly, only a relatively small amount of signal power may be dissipated to provide a signal attenuated to a level such that, when the amplifier stage gain is added thereto, a desired relative amplitude is provided to the corresponding beam forming input. However, this solution presents its own set of problems to the communication system. Specifically, such an embodiment would typically require the removal of the amplifiers from an existing BTS system configuration in order to allow disposition of controllable attenuators in the individual signal paths prior to amplification. However, because amplification of the signals to be transmitted is often a critical function, the amplifiers may be alarmed or otherwise monitored for proper operation. This may cause substantial implementation problems when attempting to provide an applique to retrofit existing BTS systems with a smart antenna providing complex radiation pattern synthesis.

Accordingly, a need exists in the art for a system and method adapted to provide controlled relative power levels with respect to simulcast signals which do not result in undesired power dissipation or other substantial waste.

A further need exists in the art for a system and method providing controlled relative power levels with respect to simulcast signals while minimizing the impact on existing system implementations.

A still further need exists in the art for a system and method providing controlled relative power levels of corresponding signals having a predetermined relative phase relationship without substantially affecting such relative phase relationship.

BRIEF SUMMARY OF THE INVENTION

The present invention is directed to a system and method in which signal power steering circuitry is utilized to provide controlled relative power levels with respect to a plurality of corresponding signals, such as signals to be simulcast in synthesizing a desired antenna beam. A preferred embodiment of the present invention utilizes a multiple stage circuit adapted to shift or steer signal power from a stage input between stage outputs.

For example, a most preferred embodiment of the present invention utilizes a matrix of back-to-back hybrid combiners, such as 90° hybrid combiners, to provide a power steering circuit. The back-to-back combiner arrangement of this embodiment provides a first hybrid combiner having a first output coupled to a first input of a second hybrid combiner and having a second output coupled to a second input of the second hybrid combiner. Preferably the back-to-back hybrid combiners have a controllable phase shifter in at least one link there between to allow control of signal power levels at the outputs of the second hybrid combiner of the back-to-back pair by selectively directing input power to the outputs of the hybrid combiner pair.

By coupling a plurality of such back-to-back hybrid combiner pairs into a matrix, stages of power steering may be accomplished according to the present invention. For example, where a four input beam forming matrix is utilized in providing four directional antenna beams, a two stage back-to-back hybrid combiner matrix may be utilized according to the present invention to provide desired relative power level distribution of a signal to each of the four beam forming inputs. Specifically, a first stage of the matrix may provide coarse power steering, such as between a first and second half of the beam forming inputs, and a second stage of the matrix may provide fine power steering, such as between individual beam forming inputs.

The preferred embodiment of the present invention is adapted to maintain, or otherwise achieve, a desired relative phase relationship of the signals provided to the beam forming inputs. For example, according to a most preferred embodiment of the present invention a zero phase relationship is maintained at the beam forming inputs. Accordingly, a preferred embodiment of the present invention includes phase control circuitry, such as disposed between one or more of the power steering stages, suitable for use in maintaining and/or providing a desired relative phase relationship. A most preferred embodiment of the present invention includes a controllable phase shifter in at least one signal path of a power steering stage to thereby control phase drift between signal paths of that particular power steering stage.

An advantage of the present invention is provided in that the corresponding signals relative power levels are provided through steering of the power to the appropriate signal path rather than through dissipation or other sinking of the signal power.

A further advantage of the present invention is that a desired relative phase relationship between the corresponding signals may be maintained.

A still further advantage of the present invention is provided in that preferred embodiment of the present invention may be implemented as an applique and, therefore, minimize the impact on an existing system implementation.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

The present invention shall be described herein with respect to a multiple beam planar antenna array in order to aid the reader in understanding the concepts of the present invention. Specifically, a preferred embodiment of the present invention shall be described with reference to a multiple beam antenna configuration providing twelve directional antenna beams, such as might be useful in providing cellular or personal communication services (PCS) wireless communications. However, it should be appreciated that the present invention is not limited in application to the specific communication system circuitry shown. Specifically, the present invention is not limited to use with respect to the antenna arrays shown and, therefore, may be utilized in arrays, whether planar or not, providing any number of antenna beams, whether fixed or adaptive beams. Moreover, the present invention is not limited to use in wireless communication systems and, therefore, may be utilized in a variety of systems in which providing power level control with respect to corresponding signals is desired. In particular, preferred embodiments of the present invention may be utilized in any system in which providing power level control with respect to corresponding signals, particularly in those systems benefitting from maintaining or providing a desired relative phase relationship.

Figure 1:
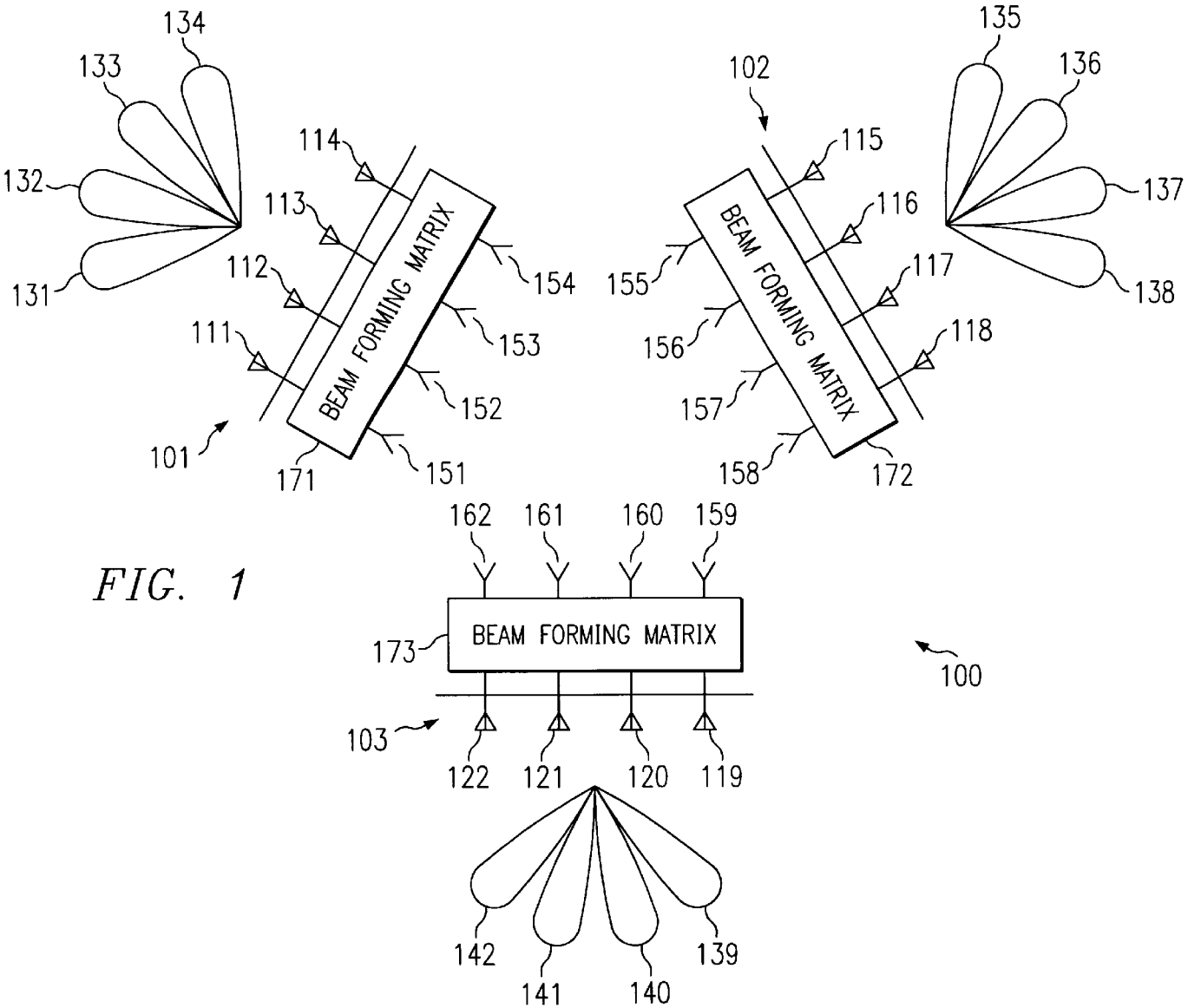
FIG. 1 shows a multiple beam antenna system which may be utilized in providing complex beam forming according to the present invention.

Directing attention to FIG. 1, a portion of a multiple beam wireless communication system is shown generally as multiple beam antenna system 100. Multiple beam antenna system 100 includes multiple beam planar array 101, having antenna beams 131–134 associated therewith, multiple beam planar array 102, having antenna beams 135–138 associated therewith, and multiple beam planar array 103, having antenna beams 139–42 associated therewith. Multiple beam planar arrays 101–103 are disposed such that antenna beams 131–142 provide substantially 360° coverage about multiple beam antenna system 100. Accordingly, multiple beam antenna system 100 is particularly well suited for use as a "smart" antenna system in a cellular or PCS communication system.

Each of multiple beam planar arrays 101–103 includes a plurality of antenna elements disposed in a predetermined configuration. Specifically, antenna elements 111–114, having a predetermined spacing there between corresponding to an operational wavelength, are disposed on a face of multiple beam planar array 101, antenna elements 115. 118, having a predetermined spacing there between corresponding to an operational wavelength, are disposed on a face of multiple beam planar array 102, and antenna elements 119–22, having a predetermined spacing there between corresponding to an operational wavelength, are disposed on a face of multiple beam planar array 103.

In operation a signal provided to a particular input of connectors 151–162 will be manipulated by one of beam forming matrices 171–173 (such as may be Butler matrices well known in the art) to provide a proper phase progression at coupled ones of antenna elements 111–122 to thereby define a corresponding antenna beam of antenna beams 131–142. For example, a signal applied to connector 151 will be manipulated by beam forming matrix 171 to provide a proper phase progression at each of antenna elements 111–114 for radiation of the signal in antenna beam 131.

It should be appreciated that the antenna beams of each particular multiple beam planar array of FIG. 1 have a common phase center. For example, each of antenna beams 131–134 are formed utilizing an appropriate relative phase progression at antenna elements 111–114 and, therefore, each of antenna beams 131–134 has a common phase center. However, the antenna beams of the various multiple beam planar arrays of FIG. 1 have a different phase center. For example, antenna beams 131–134 are formed utilizing an appropriate relative phase progression at antenna elements 111–114 while antenna beams 135–138 are formed utilizing an appropriate relative phase progression at antenna elements 115–118, which are separated in space from antenna elements 111–114, and, therefore, each of antenna beams 131–134 has a different phase center than each of antenna beams 135–138.

The above described common and different phase centers between the various antenna beams can be of significance in particular scenarios. For example, where a signal is to be communication within multiple ones of the antenna beams, such as to synthesize radiation patterns different than those of the individual antenna beam, the relationship of the phase centers of each of the beams so utilized may be of particular interest. Specifically, just as providing of a particular phase progression at the antenna elements of the antenna array may be utilized in order to provide constructive and destructive spatial combining to thereby result in a desired antenna beam, so too may this spatial combining affect signals as simulcast in multiple antenna beams. Where a signal is provided to an input associated with one antenna beam simultaneously, but offset in phase, with the signal being provided to an input associated with another antenna beam having a common phase center, the antenna beam signals may destructively combine to result in undesired nulls in the aggregate or composite synthesized antenna beam.

Accordingly, it may be desired to achieve and/or maintain a zero, or other predetermined, relative phase distribution with respect to one or more of the simulcast antenna beams. Specifically, where a signal is to be simulcast on antenna beams of a single antenna panel, such as multiple beam planar array 101, a zero relative phase distribution of this signal at each of connectors 151–154 corresponding to the beams to be used in the simulcast may be desirable.

It should be appreciated that simulcasting of signals within antenna beams having different phase centers may not be as problematic as those sharing a phase center. For example, through proper antenna system configuration, these different phase centers may be disposed such that they do not present a substantial spatial destructive combining issue when signals are simulcast. Additionally or alternatively, signal manipulation techniques may be utilized to minimize the effects of simulcasting a signal with antenna beams having a different phase center, such as the introduction of delays as shown and described in copending and commonly assigned U.S. patent application Ser. No. 09/519, 987, entitled "System and Method Providing Delays for CDMA Nulling," filed Mar. 7, 2000, the disclosure of which is hereby incorporated herein by reference.

A preferred embodiment of the present invention shall be discussed herein with reference to the antenna beams of a single panel, such as multiple beam planar array 101, of multiple beam antenna system 100 in order to better illustrate both the power shifting aspect of the present invention as well as the ability to maintain a desired phase progression. However, it should be appreciated that the present invention is not limited to use with respect to antenna beams of a single panel and, accordingly, may be utilized in providing power control among various antenna beams, including those associated with different panels and/or having different phase centers.

Figure 2:
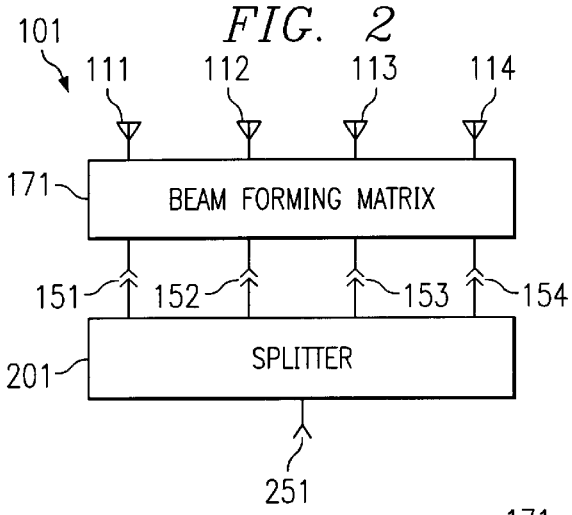
FIG. 2 shows a portion of the multiple beam antenna system of FIG. 1 adapted to provide simple antenna beam synthesization.

One way to achieve the zero relative phase distribution at the beam forming inputs described above as being desirable in synthesizing various antenna beam patterns is illustrated by the circuitry of FIG. 2. Specifically, splitter 201 is provided such that a signal, such as a CDMA or PCS sector signal associated with a BTS transceiver, input at connector 251 is power divided and an in-phase (assuming each signal path between connector 251 and connectors 151–154 are of equal length), power divided, signal component is provided to each of connectors 151–154. Accordingly, a zero relative phase distribution is provided at the inputs of the beam forming matrix and an aggregate antenna pattern may be provided, such as to synthesize a 120° communication sector.

If it is desired to produce a radiation pattern other than an aggregate of each of the four antenna beams, the simulcast signal may be removed from one or more of the beam forming inputs, such as through the use of switching devices (not shown) placed some or all of the signal paths between splitter 201 and connectors 151–154. However, it should be appreciated that providing such switchable connections results in the power associated with a power divided signal component not being utilized and, therefore, dissipated or otherwise wasted. This problem is compounded in the typical case in which the signals provided to the beam former are at transmission power levels.

Moreover, the selection of particular antenna beams in which to simulcast a signal provides relatively simple radiation pattern synthesization, limited primarily to aggregations of the underlying antenna beam geometries. More complex radiation pattern synthesization may be provided through the use of signal amplitude or power level control. A radiation pattern very different than the aggregated antenna beams of multiple beam planar array 101 may be provided by independently adjusting the signal power level of one or more of the in-phase, power divided, signal components of the circuitry of FIG. 2. For example, signal attenuators (not shown) may be placed in one or more of the signal paths between splitter 201 and connectors 151–154 to allow each signal components relative power level or signal amplitude to be individually adjusted to provide complex radiation pattern synthesization. However, this solution is not generally desirable as the signals provided to the beam former are expected to be at transmission power levels, resulting in a significant expense in wasted power.

Figure 3:
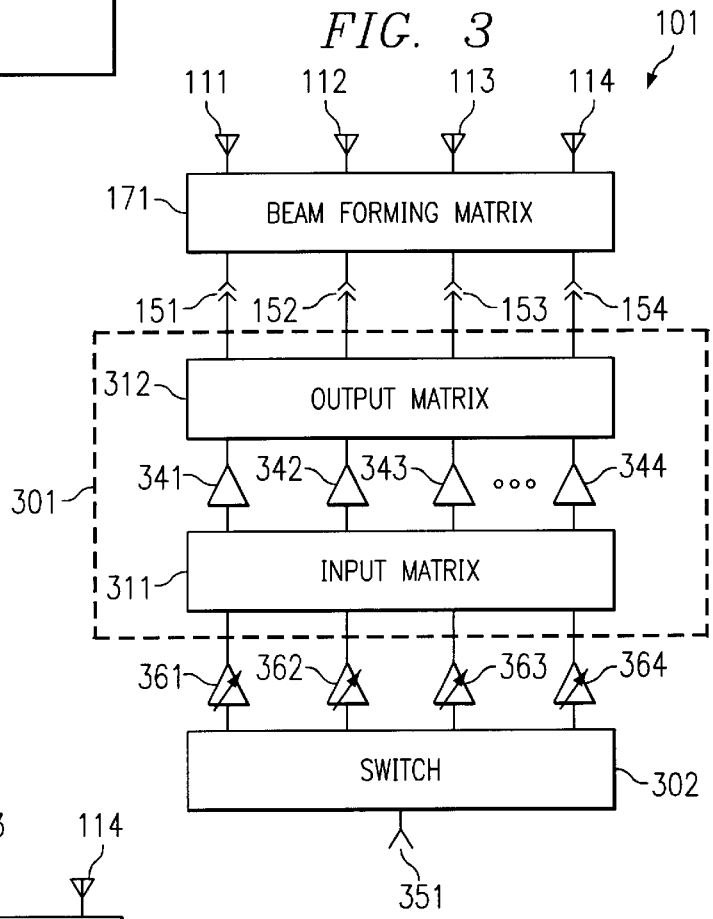
FIG. 3 shows the antenna system portion of FIG. 2 adapted to provide complex antenna beam synthesization using signal attenuation.

An alternative solution to allow complex radiation pattern synthesization is shown in FIG. 3. Shown in FIG. 3 is power amplifier suite 301, comprised of a signal distribution matrix embodied as input matrix 311, a plurality of amplifiers embodied as linear power amplifiers (LPA) 341–344, and a signal combining matrix embodied as output matrix 312. Power amplification suite 301 may be any such suit well known in the art, such as those shown and described in commonly assigned U.S. Pat. Nos. 5,955,920 and 5,917,371, the disclosures of which are hereby incorporated herein by reference. The use of a power amplifier suite may be desired in distributing the power demands of particular systems among a plurality of amplifiers. For example, CDMA signals have a high peak to average power ratio, causing such signals to be very demanding of linear power amplifier hardware for peak power handling and, therefore, may benefit from such an amplifier suite. However, alternative embodiments of the circuitry of FIG. 3 may utilize amplifiers which are unique to particular signal paths, if desired.

In the circuitry of FIG. 3 variable attenuators 361–364 are provided in the signal paths between signal input connector 355, such as may be coupled to a BTS radio transmitter, and connectors 151–154 of beam former 171. Accordingly, a signal, such as a CDMA or PCS sector signal associated with a BTS transceiver, input at connector 351 may be switchably coupled by switch 302 to one or more of connecters 151–154 (it being understood that switch 302 of this embodiment provides signal power splitting functionality in addition to switch matrix functionality) and independently power level adjusted by variable attenuators 361–364.

In contrast to the alternative embodiment of the circuitry of FIG. 2 described above, however, the variable attenuators of FIG. 3 are disposed in the signal path prior to the amplification of the signals to transmission power levels. Accordingly, the dissipation of signal power is significantly lower in the circuitry of FIG. 3 than would be expected in the alternative embodiment of FIG. 2 described above.

Although presenting an improvement in allowing complex radiation pattern synthesis, including selection of antenna beams for use in aggregate using switch 302 and providing independent power level control using variable attenuators 361–364, the circuitry of FIG. 3 may not always provide a desirable solution. For example, the circuitry of FIG. 3 presents substantial problems in implementing the circuitry as an applique to existing BTS systems. Specifically, the circuitry of FIG. 3 may require removal of amplifiers from the signal paths internal to the BTS in order to provide for signal splitting, signal switching, and/or signal attenuation, prior to the amplification of the signals. However, as the amplification of signals to transmit power levels is generally a critical function of the BTS, such removal or reconfiguring may require substantial alarm and/or monitoring reconfiguration.

Accordingly, the preferred embodiment of the present invention provides 9 circuitry for providing independent signal amplitude or power level adjustment without requiring substantial power dissipation and without requiring substantial alteration or reconfiguration of other communication circuitry. Moreover, preferred embodiments of the present invention provide signal amplitude or power level adjustment while maintaining or otherwise providing desired relative signal phase relationships in addition to the above described advantages.

Figure 4:
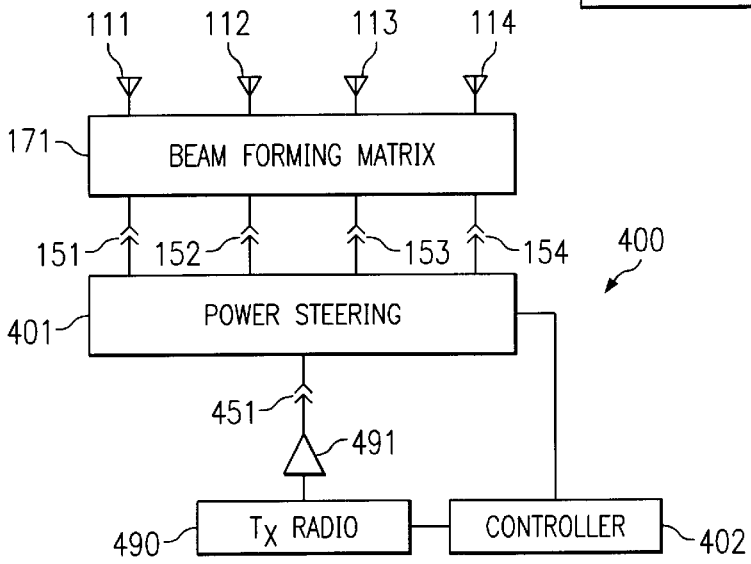
FIG. 4 shows the antenna system portion of FIG. 2 adapted to provide complex antenna beam synthesization using signal power steering techniques of a preferred embodiment of the present invention.

Directing attention to FIG. 4, a high level block diagram of a preferred embodiment of the present invention is shown generally as system 400. As shown in FIG. 4, the preferred embodiment includes power steerer 401 coupled between communications equipment, such as transmit radio 490, and beam forming matrix 171 using connectors 151–154 and 451. The signals manipulated by power steerer 401 may be at any power level desired, such as the aforementioned transmit power levels. Accordingly, the embodiment of FIG. 4 shows amplifier 491 disposed in the signal path before power steerer 401. It should be appreciated that, although shown as a single amplifier, amplifier 491 may be comprised of various components, such as the amplifier suite discussed above with reference to FIG. 3.

Also shown in the preferred embodiment of FIG. 4 is controller 402 coupled to power steerer 401. Preferably, controller [401] 402 is operable to provide control signals to power steerer 401 to result in the desired steering of power of a signal input at connector 451 as output at ones of connectors 151–154. Controller 402 may also be coupled to other system components, such as transmit radio 490, in order to be provided information useful in effecting the above described power steering and/or to provide such components information with respect to the power steering of particular signals. For example, controller 402 may receive information with respect to when a signal is active at transmit radio 490 in order to provide steering signals and thereby form a desired radiation pattern with respect to that signal. Additionally or alternatively, controller 402 may receive information from a scan receiver, or other device in the receive link, providing information with respect to any or all of a position, a direction, an angle of arrival, a distance, or like communication tactical information in order to determine and/or accomplish a desired power steering solution.

Controller 402 of the present invention may be provided by a processor-based system operable under control of an instruction set defining operation as described herein. For example, controller 402 may be a general purpose processor-based system, such as may comprise an INTEL PENTIUM class processor platform, MOTOROLA 680×0 or POWERPC processor platforms or the like, including memory, such as RAM, hard disk storage, and/or the like, operator input/output, such as a keyboard, pointing device, display monitor, and/or the like, and data input/output, such as a network interface, serial interface, parallel interface, peripheral interface, proprietary data interface, and/or the like.

Figure 5:
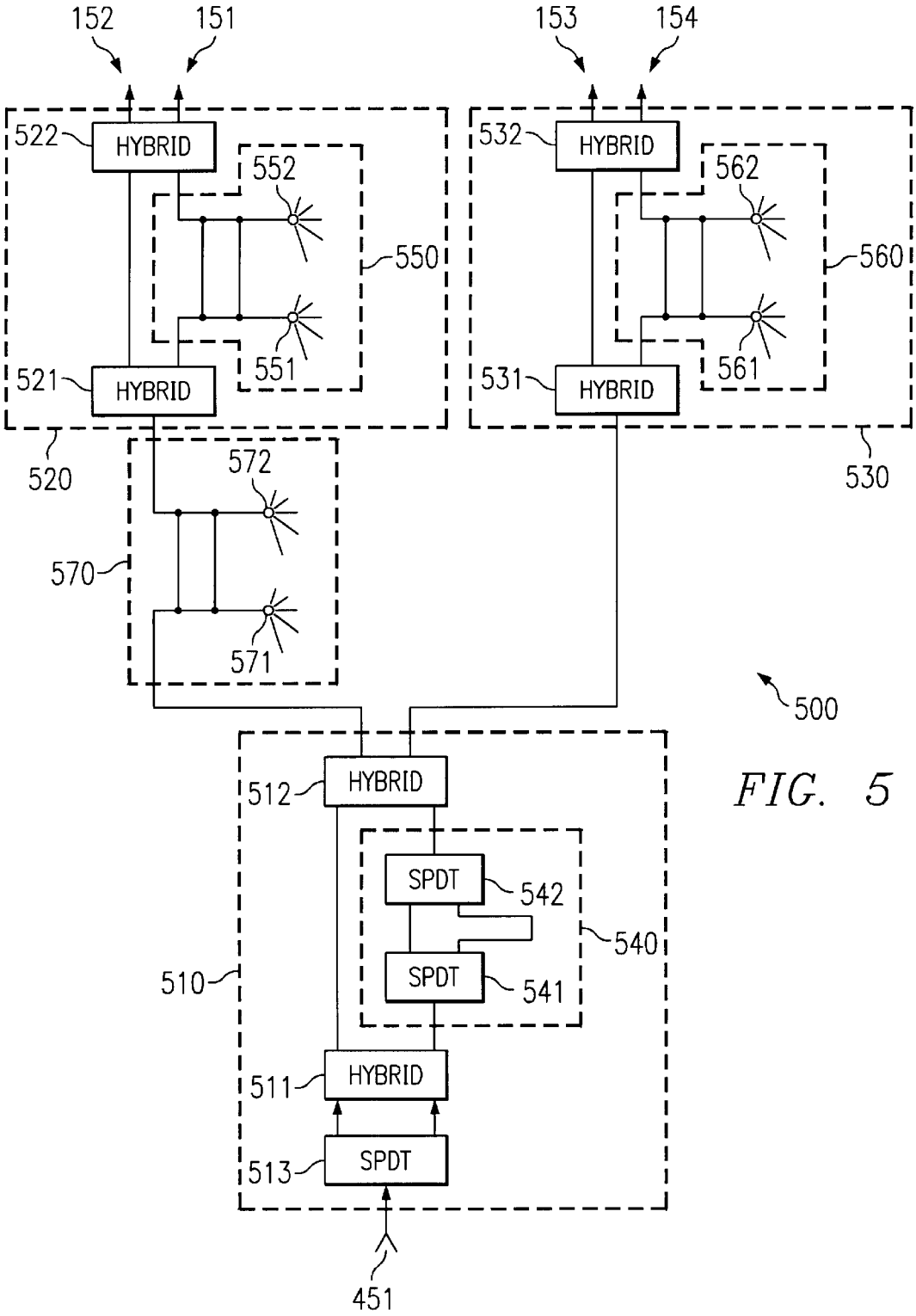
FIG. 5 shows a preferred embodiment of the power steering circuitry of FIG. 4.
Figure 6A:
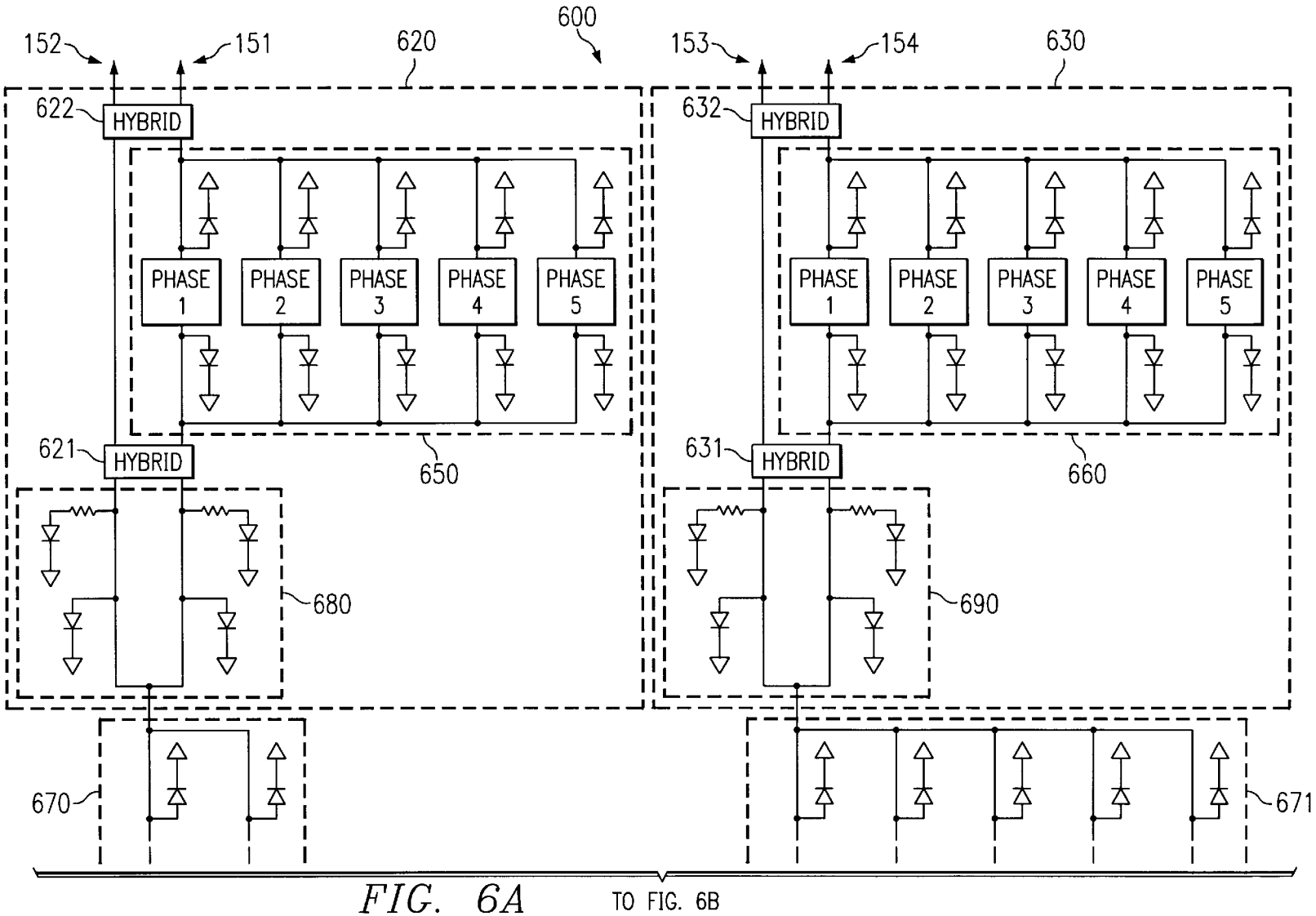
FIGS. 6A and 6B show an alternative preferred embodiment of the power steering circuitry of FIG. 4.
Figure 6B:
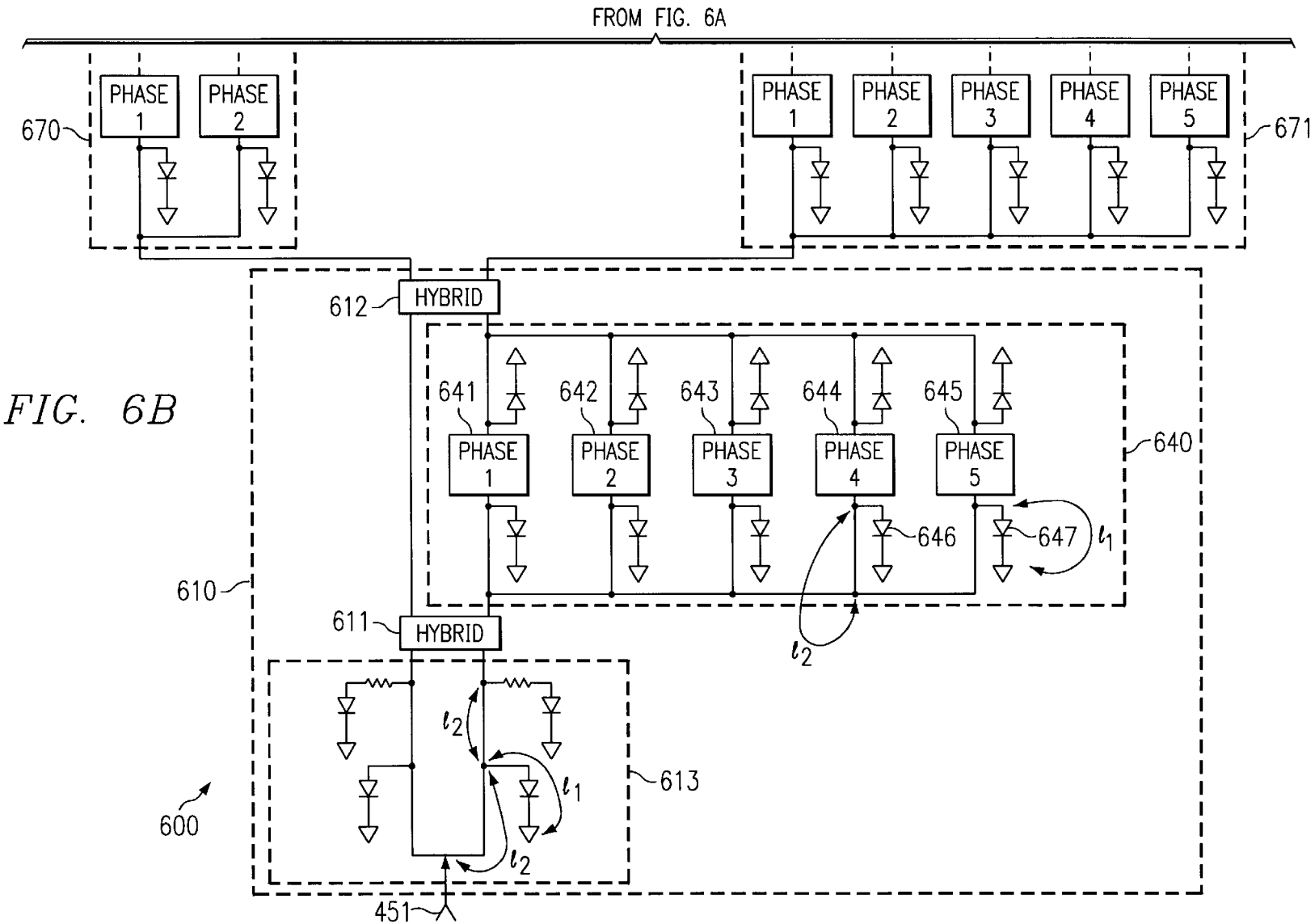

Alternative preferred embodiments of circuitry suitable for providing power steering of power steerer 401 are shown in FIGS. 5, 6A and 6B. Specifically, FIG. 5 shows an electromechanical switch implementation of a preferred embodiment of the circuitry while FIGS. 6A and 6B show a switching diode implementation of a preferred embodiment of the circuitry.

Directing attention to FIG. 5, power steering circuitry 500 is shown to provide steering of signal power in a power steering matrix comprising two stages. Specifically, the first stage includes controllable power shifter 510 and the second stage includes controllable power shifters 520 and 530. The power shifters of this embodiment are comprised of a back-to-back hybrid combiners, such as 90° hybrid combiners. Specifically, controllable power shifter 510 includes back-to-back hybrid combiners 511 and 512, controllable power shifter 520 includes back-to-back hybrid combiners 521 and 522, and controllable power shifter [520] 530 includes back-to-back hybrid combiners 531 and 532.

It should be appreciated that the back-to-back combiner arrangement provides a first hybrid combiner having a first output coupled to a first input of a second hybrid combiner and having a second output coupled to a second input of the second hybrid combiner. Preferably the back-to-back hybrid combiners have a controllable phase shifter in at least one link there between to allow control of signal power levels at the outputs of the second hybrid combiner of the back-to-back pair by selectively directing input power to the outputs of the hybrid combiner pair. For example, controllable power shifter 510 includes phase shifter 540, preferably comprising of switches 541 and 542, such as may be high power terminated switches, disposed in one link between back-to-back hybrid combiners 511 and 512 to allow selection of phase adjustment. In the preferred embodiment switches 541 and 542 select different signal path segment links and, thereby, provide a selectable phase shift. Controllable power shifters 520 and 530 include phase shifters 550 and 560, preferably comprising of high power multi-position electromechanical switches (i.e., a single pole multiple position switch), switches 551, 552, 561, and 562 respectively, to allow selection between a range of phase changes. Switches 551, 552, 561, and 562 may preferably be operated to allow selection of phase shifts in the range of ±25° perhaps in increments of 5° (it being appreciated that particular embodiments of the present invention may accomplish negative phase shifts through utilization of corresponding phase shifting structure on the other link between the back-to-back hybrid combiners). For example, switches 551, 552, 561, and 562 may operate to switch various lengths of transmission line segments into and/or out of the signal path used to conduct the signal.

It should be appreciated that, although shown as utilizing different switching mechanisms, the stages of the present invention may utilize the same switching structure in various stages or throughout the power steering circuitry. However, in the preferred embodiment of FIG. 5, different switch mechanisms are used in the first stage in order to accommodate the higher power levels expected to be present therein (it being understood that as the signal passes through power steering circuitry 500 the power is shifted among the various signal paths often resulting in less power being handled by subsequent legs of the circuitry). Accordingly, high power single pole double throw switches are used in the first stage in the illustrated embodiment. Although not providing as large of range of phase shift selection as the switches of the second stage, the first stage of embodiment of FIG. 5 is primarily to provide for the selection of left or right amplitude bias and it is expected that many implementations will operate satisfactorily with small range of selection in this first stage.

The preferred embodiment power shifter 510 includes switch 513 to select bias and switches 541 and 542 to select level of bias to provide various selections of power biasing. In operation switch 513, accepting a full power input signal, is used to select whether there is to be a left or right amplitude bias, i.e., whether the amplitude adjustment is to result in a power shift bias to the left half (antenna elements 111 and 112) or the right half (antenna elements 113 and 114) of the antenna. If a left bias is desired switch 513 switches the input signal to the left input of hybrid combiner 511. If a right bias is desired switch 513 switches the input signal to the right input of hybrid combiner 511.

The nature of the hybrid combiners utilized according to the present invention results in a portion of the signal input at either hybrid input being output at both hybrid outputs. Specifically, the 90° hybrid combiners of the present invention will operate to power split a signal input at a hybrid input such that a portion of the signal power is output in phase at the hybrid output disposed directly above the hybrid input used and another portion of the signal power is output in quadrature (90° out of phase) at the hybrid output disposed on the diagonal to the hybrid input used. Accordingly, regardless of the position of switch 513 a portion of the signal input appears at each of the outputs of hybrid combiner 511.

If the signals present on the two inputs of hybrid combiner 512 are coherent and out of phase an amount corresponding to the hybrid combiner (e.g. 90°) they will combine therein to again provide a full power signal at one hybrid output. Accordingly, if hybrid combiners 511 are 512 are coupled back-to-back with no phase adjusting circuitry disposed there between, a substantially full power signal would be output at a hybrid output of hybrid combiner 512 corresponding to the hybrid input of hybrid combiner 511 used. However, by introducing a phase shift in one or both of the links between these back-to-back hybrid combiners the signal power output may be altered as the signals input to hybrid combiner 512, although still coherent, may no longer have a phase relationship corresponding to the hybrid combiner.

Accordingly, switches 541 and 542 may be utilized to select/deselect a phase shift in one link between hybrid combiners 511 and 512 and thereby determine the level of amplitude bias resulting from the left or right amplitude bias selected by switch 513. Specifically, if switch 513 selects left amplitude bias, use of switches 541 and 542 to select a phase shift will minimize the amplitude bias differential between the left and right halves of the antenna (e.g., the left half of the antenna will be provided somewhat more power than the right half of the antenna). However, if switch 513 selects left amplitude bias, use of switches 541 and 542 to deselect a phase shift will maximize the amplitude bias differential between the left and right halves of the antenna (e.g., where no phase shift is selected the antenna will be provided substantially all signal power to the left half of the antenna). Similarly, if switch 513 selects right amplitude bias, use of switches 541 and 542 to select a phase shift will minimize the amplitude bias differential between the right and left halves of the antenna (e.g., the right half of the antenna will be provided somewhat more power than the left half of the antenna). However, if switch 513 selects right amplitude bias, use of switches 541 and 542 to deselect a phase shift will maximize the amplitude bias differential between the right and left halves of the antenna (e.g., where no phase shift is selected the antenna will be provided substantially all signal power to the right half of the antenna).

Having described in detail the operation of power shifter 510 of the first stage of power steering circuitry 500, it should be appreciated that operation of power shifters 520 and 530 of the second stage of power steering circuitry 500 operate in substantially the same way. However, in the embodiment of FIG. 5, the power input to each of power shifters 520 and 530 is shifted between the antenna elements of the respective halves of the antenna. Of course, the circuitry of FIG. 5 may be scaled to provide additional stages, if desired, such that the second stage shifts power between subgroups of the final outputs of power steering circuitry 500 and a subsequent stage provides the granularity to shift power between these final outputs.

Power shifters 520 and 530 of the illustrated embodiment are configured somewhat differently than power shifter 510 described above. Specifically, power shifters 520 and 530 of the illustrated embodiment utilize a single hybrid input of hybrid combiners 521 and 531 respectively. Although a switching arrangement such as switch 513 of power shifter 510 might be employed in either or both of power shifters 520 and 530, the preferred embodiment does not utilize such a switch and, instead, relies upon the phase shifters, phase shifters 551, 552, 561, and 562, disposed between back-to-back hybrid combiners 521 and 522 and back-to-back hybrid combiners 531 and 532 respectively. Specifically, the preferred embodiment phase shifters 551, 552, 561, and 562 provide sufficient phase adjustment freedom and/or resolution to allow for their operation to satisfactorily select both the side (i.e., left or right) and level of amplitude bias between the outputs of power shifters 520 and 530.

It should be appreciated that the independent adjustment of power shifters 520 and 530 according to the present invention to provide signals of desired amplitudes to each of connectors 551–554 can result in phase drift or a phase differential between the signals associated with power shifter 520 relative to the signals associated with power shifter 530. Accordingly, the preferred embodiment includes phase shift compensator 570. In the illustrated embodiment phase shift compensator 570 includes switches 571 and 572. Preferably switches 571 and 572 are high power multi-position electromechanical switches, similar to switches 551, 552, 561, and 562 described above, to allow selection between a range of phase changes, such as to allow selection of phase shifts in the range of ±25° perhaps in increments of 5° (it being appreciated that particular embodiments of the present invention may accomplish negative phase shifts through utilization of corresponding phase shifting structure on the other link of the second stage). For example, switches 571 and 572 may operate to switch various lengths of transmission line segments into and/or out of the signal path used to conduct the signal.

Although not shown, the preferred embodiment power steering circuitry 500 includes control signal links from a controller, such as controller 402 of FIG. 4, to provide dynamic operational control of particular components thereof. For example, controller 402 may be coupled to any or all of power shifters 510, 520, and 530 and/or phase shift compensator 570 in order to provide control of switches therein. Accordingly, controller 402 may provide a desired signal amplitude relationship at each of connectors 515–154 to result in the complex synthesization of a desired radiation pattern.

It is expected that a typical implementation of electromechanical switches such as shown in FIG. 5 will require an appreciable amount of time, such as approximately 20 milliseconds, in order to accomplish a switching operation. Although a relatively short span of time, it may correspond to a significant portion data communicated, such as a full frame of data in a high speed digital system, such as a CDMA or TDMA system. Accordingly, it may be desired to provide circuitry which is adapted to accomplish a switching operation more quickly. For example, FIGS. 6A and 6B provide power steering circuitry 600 configured substantially the same as that of power steering circuitry 500 of FIG. 5 except switching is accomplished using switching diodes. The switching diodes of the embodiment of FIGS. 6A and 6B are expected to accomplish a switching operation appreciably quicker than the electromechanical switches of FIG. 5, such as an order of magnitude more quickly than that of the typical electromechanical switches. Accordingly, switching operations associated with the circuitry of FIGS. 6A and 6B may be expected to correspond to a lesser portion of data communicated, such as symbols rather than frames of data in a high speed digital system.

In the embodiment of FIGS. 6A and 6B, it should be appreciated that power steering circuitry 600 provides steering of signal power in a power steering matrix comprising two stages substantially corresponding to the stages of FIG. 5. Accordingly, the first stage includes controllable power shifter 610 and the second stage includes controllable power shifters 620 and 630. As with the power shifters of the embodiment of FIG. 5, the power shifters of this embodiment are comprised of a back-to-back hybrid combiners, such as 900 hybrid combiners. Specifically, controllable power shifter 610 includes back-to-back hybrid combiners 611 and 612, controllable power shifter 620 includes back-to-back hybrid combiners 621 and 622, and controllable power shifter 620 includes back-to-back hybrid combiners 631 and 632.

Controllable power shifter 610 includes phase shifter 640, such as may be comprised of a plurality of switchable diodes, disposed in one link between back-to-back hybrid combiners 611 and 612 to allow selection between a range of phase changes. Similarly, controllable power shifters 620 and 630 include phase shifters 650 and 660, such as may be comprised of a plurality of switchable diodes, to allow selection between a range of phase changes. For example, phase shifters 640, 650 and 650 may be operated to bias various ones of the diodes, and thereby "switch" their associated phase change in or out of the signal path to allow selection of phase shifts in the range of ±25° perhaps in increments of 5° (it being appreciated that particular embodiments of the present invention may accomplish negative phase shifts through utilization of corresponding phase shifting structure on the other link between the back-to-back hybrid combiners). For example, the diodes of phase shifters 640, 650, and 660 may operate to switch (e.g., providing an electronic version of a single pole multiple throw switch) various lengths of transmission line segments into and/or out of the signal path used to conduct the signal. Accordingly, phase shifters 640, 650, and 660 may be utilized to select/deselect a phase shift (perhaps through a combination of the available phase adjusting components) in one link between the back-to-back hybrid combiners of a power shifter.

The preferred embodiment power shifters 610, 620, and 630 include switches 613, 680, and 690 respectively to select a desired bias, substantially as described above with respect to switch 513. Operating in combination with a corresponding one of phase shifters 640, 650, and 660, power may be steered between the two outputs of output hybrid combiners 612, 622, and 632, respectively. Specifically, switches 613, 680, and 690 include switching diode and loads (preferably an approximately 500 resistive load) configured such that when the diodes are properly biased to "switch" on or off in the proper combination, single pole double throw switching functionality is provided. Accordingly, each of switches 613, 680, and 690 may be operated to select output bins for an associated power shifter. Embodiment 600 may also include phase shift compensators 670 and 671.

In order to provide the diode switching of the preferred embodiment, particular relationships between the various components are preferably provided. For example, in order to predictably provide signals having particular phase relationships, each phase adjusting component (e.g., phase adjusting components 641, 642, 643, 644, and 645) of each phase shifter (e.g. phase shifter 640) is preferably provided a same signal path length between the corresponding back-to-back hybrid combiners (e.g., hybrid combiners 611 and 613). Moreover, the switching diodes (e.g., switching diodes 646 and 647) are disposed at a position in the signal path (e.g., distance $l_1$ from signal ground (where appropriate) and/or distance $l_2$ from a next component) so as to effectively conduct and/or block transmitted signals. For example, the distances $l_1$ and $l_2$ may be predetermined fractions of the wavelength of signals to be communicated in order to minimize the introduction of reflected signals in the signal path. According to a preferred embodiment $1_1$ is $\lambda/2$ (½ the communicated wavelength) and $1_2$ is $\lambda/4$ (¼ the communicated wavelength).

It should be appreciated that the system configuration of FIG. 4, such as may utilize the circuitry of FIGS. 5, 6A, and 6B, provides amplitude adjustment of a signal, such as a cellular or PCS sector signal, input at connector 451 to provide a desired synthesized radiation pattern. If multiple overlapping synthesized radiation patterns are desired, such as to provide overlapping sectors of a cellular of PCS service or to provide multiple services (e.g., cellular and PCS) independently through a common antenna aperture, the system configuration is of the present invention may be scaled accordingly.

Figure 7:
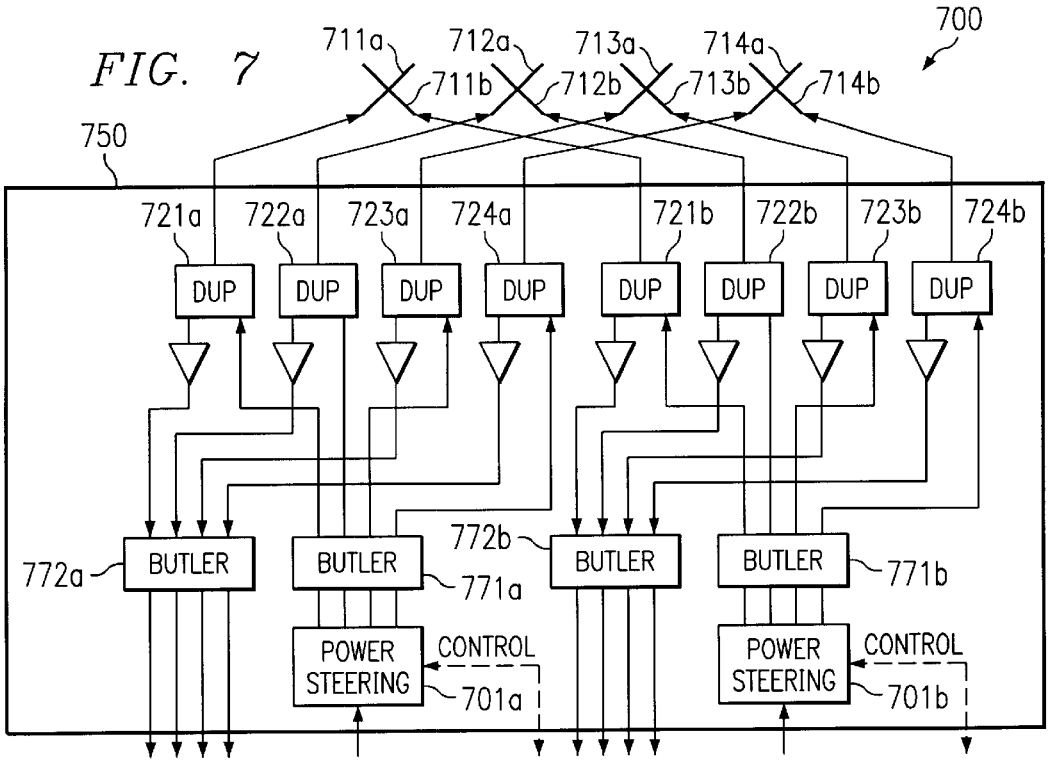
FIGS. 7 and 8 show alternative embodiments of signal power steering systems of the present invention scaled to accommodate independent power steering of multiple signals.

Directing attention to FIG. 7, a preferred embodiment of the present invention scaled to accommodate independent overlapping radiation pattern synthesization is shown generally as system 700. Similar to the embodiment of FIG. 4, the preferred embodiment of FIG. 7 includes power steerer 701 a coupled between communications equipment, such as a transmit radio of a first service, and beam forming matrix 771*a*. However, unlike the embodiment of FIG. 4, the embodiment of FIG. 7 also includes power steerer 701*b* coupled between communications equipment, such as a transmit radio of a second service, and beam forming matrix 771*b*.

It should be appreciated that power steerers 701*a* and 701*b* may be provided utilizing circuitry such as shown in FIGS. 5, 6A, and 6B. The illustrated control signals provided to power steerers 701*a* and 701*b* may be provided by a controller such as controller 402 described above. Of course a separate controller may be utilized with respect to each of power steerers 701*a* and 701*b* or a common controller may be utilized therewith.

The preferred embodiment of FIG. 7 utilizes a cross polarized antenna, having slant right antenna elements associated with the first service and slant left antenna elements associated with the second service. Accordingly, an antenna aperture A consistent with that of FIG. 4 may be utilized to provide the dual services. It should be appreciated that the signals of each of the beam forming signal paths, i.e., the signal paths of each service, may be combined for communication via common antenna elements, such as through the use of a Wilkinson combiner. However, as these signals are expected to be out of phase with respect to each other and/or non-coherent, a substantial power loss would be expected from such combining. Accordingly, the preferred embodiment utilizes signal isolation, such as is provided by the aforementioned cross polarization of antenna elements, to avoid such a signal loss.

Although the illustrated embodiment shows the use of slant left and slant right polarization to isolate signals, other signal isolation techniques may be utilized. For example, other orthogonal polarizations may be utilized, such as vertical/horizontal or circular left/circular right. Additionally or alternatively signal isolation may be achieved through techniques such as time division access to shared components and the like.

It should be appreciated that the components shown in FIG. 7 may all be disposed up-mast, on the roof top, or at any other position where an antenna structure may be deployed. For example, container 750 may present a hermetically sealed roof top enclosure for the components therein in order to facilitate their deployment in the typically harsh environments in which antenna structure is generally deployed.

Figure 8:
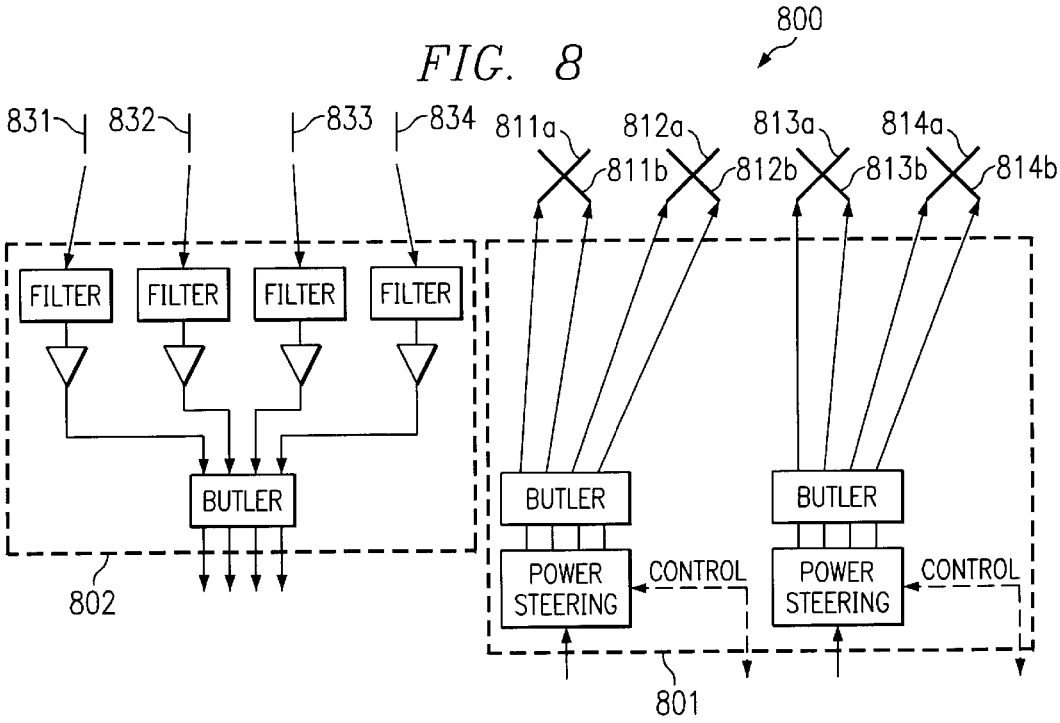

System 700 of FIG. 7 is configured to provide both forward link and reverse link communication. Accordingly, duplexers 721*a*–724*a* and 721*b*–724*b* are coupled to antenna elements 711*a*–714*a* and 711*b*–714*b* to isolate forward and reverse link circuitry. However, it should be appreciated that the use of duplexers for signal isolation typically results in signal power loss, such as on the order of several decibels. Accordingly, the alternative embodiment of FIG. 8 provides system 800 including antenna elements 811*a*–814*a*, 811*b*–814*b*, and 831–834. Antenna elements 811*a*–814*a* and 811*b*–814*b* are preferably associated with one link direction, such as the forward link associated with forward link circuitry 801. Similarly, antenna elements 831–834 are preferably associated with another link direction, such as the reverse link associated with reverse link circuitry 802. Using the separate antenna elements of FIG. 8 for the forward and reverse links eliminates the duplexers of FIG. 7 and, therefore, the signal power loss associated therewith.

It should be appreciated that the present invention is not limited to use with respect to antenna beams of a single panel and, accordingly, may be utilized in providing power control among various antenna beams, including those associated with different panels and/or having different phase centers. For example, the circuitry of the preferred embodiment may be sealed, such as to add an appropriate number of stages, to couple to the antenna beam inputs of multiple ones of the antenna panels. Additionally, or alternatively, the circuitry of the preferred embodiment may be scaled, such as to add a number of power steering circuits. For example, the preferred embodiment circuitry shown with reference to multiple beam planar array 101, may be repeated to provide circuitry to couple to multiple beam planar array 102 and/or multiple beam planar array 103.

It should be appreciated that the power steerers of the present invention may be utilized in combination with various other circuitry, if desired. For example, rather than the two power steerers shown in FIGS. 7 and 8, a power steerer may be utilized in combination with circuitry providing individual antenna beam signal paths, i.e., one forward link of the circuitry of FIG. 7 is configured with only a Butler Matrix as shown in the reverse links of the illustrated system.

Although preferred embodiments of the present invention have been described with reference to the use of various lengths of signal transmission line segments to provide phase adjustment, it should be appreciated that the present invention may utilize any number of suitable means for providing phase adjustment. For example, surface acoustic wave (SAW) devices, digital signal processing (DSP), and like devices may be utilized according to the present invention.

Moreover, although the preferred embodiments of the present invention have been described with reference to complex radiation pattern synthesis with respect to wireless transmission of signals, it should be appreciated that there is no limitation to the present invention being utilized in for such a purpose. For example, the concepts of the present invention may be applied in the receive signal path of a wireless communication system. Additionally or alternatively, the concepts of the present invention may be utilized in any situation where a plurality of signals require amplitude adjustment.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system providing steering of input signal power between a plurality of outputs, said system comprising:

a first signal combiner element having at least one input configured to accept said input signal and at least two outputs;

a second signal combiner element having at least two inputs and at least two outputs, wherein said at least two inputs of said second signal combiner element are coupled to said at least two outputs of said first signal combiner element, and wherein said plurality of outputs include said at least two outputs of said second signal combiner element; and a controllable phase shifter disposed in a signal path connecting an output of said at least two outputs of said first signal combiner element with an input of said at least two inputs of said second signal combiner element.

2. The system of claim 1, wherein said at least two outputs of said first signal element have a predetermined phase offset with respect to each other.

3. The system of claim 2, wherein said predetermined phase offset is substantially 90°.

4. The system of claim 1, wherein said at least two outputs of said second signal combiner element have a predetermined phase offset with respect to each other.

5. The system of claim 4, wherein said predetermined phase offset is substantially 90°.

6. The system of claim 1, further comprising:

controllable bias selection circuitry coupled to said at least one input of said first signal element, wherein said bias selection circuitry is operable to select a bias of power with respect to a subset of outputs of said plurality of outputs.

7. The system of claim 6, wherein operation of said controllable phase shifter provides selection of a level of said bias of power with respect to said subset of outputs of said plurality of outputs.

8. The system of claim 1, wherein said controllable phase shifter comprises:

a plurality of different phase shift values selectable in operation of said system.

9. The system of claim 8, wherein said plurality of different phase shift values define a range of phase shifts incremented in approximately 5° increments.

10. The system of claim 8, wherein said plurality of different phase shift values define approximately a 50° range of phase shifts.

11. The system of claim 8, wherein said plurality of different phase shift values define a range of phase shifts from approximately −25° to approximately +25°.

12. A system providing steering of input signal power between a plurality of outputs, said system comprising:

a first power shifting stage having at least one input configured to accept said input signal and at least two outputs, wherein said first stage provides power shifting between subsets of said plurality of outputs; and a second power shifting stage having at least two inputs and more than two outputs, wherein said at least two inputs of said second stage are coupled to said at least two outputs of said first stage, wherein said second stage provides power shifting between outputs of said subsets of said plurality of outputs.

13. The system of claim 12, wherein said first stage comprises:

a first signal combiner having at least one input and at least two outputs, wherein said at least one input corresponds to said at least one input of said first stage;

a second signal combiner having at least two inputs and at least two outputs, wherein said at least two inputs of said second signal combiner are coupled to said at least two outputs of said first signal combiner, and wherein said at least two outputs of said second signal combiner correspond to said at least two outputs of said first stage; and a controllable phase shifter disposed in a signal path connecting an output of said at least two outputs of said first signal combiner with an input of said at least two inputs of said second signal combiner.

14. The system of claim 13, wherein said first and second signal combiners each comprise a hybrid combiner.

15. The system of claim 13, wherein said controllable phase shifter comprises at least one high power single pole double throw switch.

16. The system of claim 15, wherein said high power single pole double throw switch comprises an electromechanical switch.

17. The system of claim 15, wherein said high power single pole double throw switch comprises a diode switching circuit.

18. The system of claim 15, wherein said controllable phase shifter comprises at least one selectable signal path providing a predetermined signal propagation delay.

19. The system of claim 13, wherein said controllable phase shifter comprises at least one high power single pole multiple throw switch.

20. The system of claim 19, wherein said high power single pole multiple throw switch comprises a multi-position electromechanical switch.

21. The system of claim 19, wherein said high power single pole multiple throw switch comprises a diode switching circuit.

22. The system of claim 19, wherein said controllable phase shifter comprises a plurality of selectable signal paths ones of which provide a different predetermined signal propagation delay.

23. The system of claim 13, wherein said first stage further comprises:

controllable bias selection circuitry coupled to said at least one input of said first signal combiner, wherein said bias selection circuitry is operable to select a bias of power with respect to said at least two outputs of said first stage.

24. The system of claim 23, wherein operation of said controllable phase shifter provides selection of a level of said bias of power with respect to said subset of outputs of said plurality of outputs.

25. The system of claim 13, further comprising:

a controller coupled to said controllable phase shifter and operable to provide control signals thereto to thereby at least in part control said power shifting between subsets of said plurality of outputs.

26. The system of claim 25, wherein said controller provides said control signals at least in part as a function of communication metrics selected from the group consisting of:

a position of a corresponding communication system;

a direction of a corresponding communication system;

an angle of arrival of a signal of a corresponding communication system; and a distance to a corresponding communication system.

27. The system of claim 12, wherein said second stage comprises:

a first signal combiner having at least one input and at least two outputs, wherein said at least one input of said first signal combiner corresponds to a first input of said at least two inputs of said second stage;

a second signal combiner having at least two inputs and at least two outputs, wherein said at least two inputs of said second signal combiner are coupled to said at least two outputs of said first signal combiner, and wherein said at least two outputs of said second signal combiner correspond to outputs of said more than two outputs said second stage; and a third signal combiner having at least one input and at least two outputs, wherein said at least one input of said third signal combiner corresponds to a second input of said at least two inputs of said second stage;

a fourth signal combiner having at least two inputs and at least two outputs, wherein said at least two inputs of said fourth signal combiner are coupled to said at least two outputs of said third signal combiner, and wherein said at least two outputs of said fourth signal combiner correspond to outputs of said more than two outputs said second stage;

a first controllable phase shifter disposed in a signal path connecting an output of said at least two outputs of said first signal said at least two inputs of said second signal combiner; and a second controllable phase shifter disposed in a signal path connecting an output of said at least two outputs of said third signal combiner with an input of said at least two inputs of said fourth signal combiner.

28. The system of claim 27, wherein said first, said second, said third, and said fourth signal combiners each comprise a hybrid combiner.

29. The system of claim 27, wherein said first and said second controllable phase shifters each comprises at least one high power single pole double throw switch.

30. The system of claim 29, wherein said high power single pole double throw switch comprises an electromechanical switch.

31. The system of claim 29, wherein said high power single pole double throw switch comprises a diode switching circuit.

32. The system of claim 29, wherein said first and said second controllable phase shifters each comprise at least one selectable signal path providing a predetermined signal propagation delay.

33. The system of claim 27, wherein said first and said second controllable phase shifters each comprise at least one high power single pole multiple throw switch.

34. The system of claim 33, wherein said high power single pole multiple throw switch comprises a multi-position electro-mechanical switch.

35. The system of claim 33, wherein said high power single pole multiple throw switch comprises a diode switching circuit.

36. The system of claim 33, wherein said first and said second controllable phase shifters each comprise a plurality of selectable signal paths ones of which provide a different predetermined signal propagation delay.

37. The system of claim 27, wherein said second stage further comprises:

first switching circuitry coupled to said at least one input of said first signal combiner, wherein said first switching circuitry is operable to select a bias of power with respect to said at least two outputs of said second signal combiner; and second switching circuitry coupled to said at least one input of said third signal combiner, wherein said second switching circuitry is operable to select a bias of power with respect to said at least two outputs of said fourth signal combiner.

38. The system of claim 37, wherein operation of said first controllable phase shifter provides selection of a level of said bias of power with respect to said at least two outputs of said second signal combiner, and wherein operation of said second controllable phase shifter provides selection of a level of said bias of power with respect to said at least two outputs of said fourth signal combiner.

39. The system of claim 27, further comprising:

a controller coupled to said first controllable phase shifter and said second controllable phase shifter and operable to provide control signals thereto to thereby at least in part control said power shifting between said outputs of said subsets of said plurality of outputs.

40. The system of claim 39, wherein said controller provides said control signals at least in part as a function of communication metrics selected from the group consisting of:

a position of a corresponding communication system;

a direction of a corresponding communication system;

an angle of arrival of a signal of a corresponding communication system; and a distance to a corresponding communication system.

41. The system of claim 12, further comprising:

a phase compensation circuit disposed in a signal path connecting an output of said at least two outputs of said first stage with an input of said at least two inputs of said second stage.

42. The system of claim 41, wherein said phase compensation circuit comprises at least one high power single pole multiple throw switch.

43. The system of claim 42, wherein said high power single pole multiple throw switch comprises a multi-position electromechanical switch.

44. The system of claim 42, wherein said high power single pole multiple throw switch comprises a diode switching circuit.

45. The system of claim 42, wherein said phase compensation circuit comprises a plurality of selectable signal paths ones of which provide a different predetermined signal propagation delay.

46. The system of claim 42, further comprising:

a controller coupled to said phase compensator circuit and operable to provide control signals thereto to thereby at least in part control a desired phase relationship between said subsets of said plurality of outputs.

47. The system of claim 12, wherein said system further comprises:

a plurality of signal transducers associated with said plurality of outputs;

a third power shifting stage having at least one input configured to accept a second input signal and at least two outputs, wherein said second stage provides power shifting between subsets of said plurality of signal transducers; and a fourth power shifting stage having at least two inputs and more than two outputs, wherein said at least two inputs of said second stage are coupled to said at least two outputs of said third stage, wherein said fourth stage provides power shifting between signal transducers of said subsets of said plurality of signal transducers.

48. The system of claim 47, wherein said input signal and said second input signal are associated with signals of different communication services.

49. The system of claim 47, wherein said input signal and said second input signal are associated with communication service signals to be provided in at least partially overlapping radiation patterns.

50. The system of claim 47, wherein said plurality of signal transducers comprise antenna elements.

51. The system of claim 50, wherein said antenna elements are configured to coupled antenna elements having a first attribute to said outputs of said second power shifting stage and antenna elements having a second attribute to said outputs of said fourth power shifting stage.

52. The system of claim 51, wherein said first and second attributes provide signal orthogonality.

53. The system of claim 52, wherein signal orthogonality comprises cross polarization.

54. A method for providing a desired power distribution at a plurality of outputs, said method comprising:

splitting an input signal into a plurality of signal components;

phase adjusting one or more of said signal components; and combining at least two of said plurality of signal components after said phase adjustment.

55. The method of claim 54, further comprising:

providing a first signal output after said combining;

providing a second signal output after said combining;

splitting said first signal output into a plurality of first output signal components;

phase adjusting one or more of said first output signal components;

combining ones of said plurality of first output signal components after said phase adjustment;

splitting said second signal output into a plurality of second output signal components;

phase adjusting one or more of said second output signal components; and combining ones of said plurality of second output signal components after said phase adjustment.

56. The method of claim 55, further comprising:

compensating a phase differential between said first signal output and said second signal output.

57. The method of claim 54, further comprising:

providing said signal components after said combining to inputs of a multiple beam antenna array.

58. The method of claim 57, wherein said input signal is a PCS wireless communication signal.

59. The method of claim 57, wherein said input signal is a cellular wireless communication signal.

60. The method of claim 54, wherein each of said splitting, said phase adjusting, and said combining are separately provided for a first input signal and a second input signal.

61. The method of claim 60, wherein said first input signal and said second input signal are associated with different communication services.

62. The method of claim 60, wherein said first input signal and said second input signal are associated with a same communication service.

* * * * *